US009060591B1

(12) United States Patent
White

(10) Patent No.: US 9,060,591 B1
(45) Date of Patent: Jun. 23, 2015

(54) TWO-POSITION HANDLE

(71) Applicant: Brian L. White, St. Augustine, FL (US)

(72) Inventor: Brian L. White, St. Augustine, FL (US)

( * ) Notice: Subject to any disclaimer, the term of this patent is extended or adjusted under 35 U.S.C. 154(b) by 0 days.

(21) Appl. No.: 14/475,825

(22) Filed: Sep. 3, 2014

Related U.S. Application Data

(60) Provisional application No. 61/877,897, filed on Sep. 13, 2013.

(51) Int. Cl.
*A47B 95/02* (2006.01)
*A45F 5/10* (2006.01)

(52) U.S. Cl.
CPC ... *A45F 5/10* (2013.01); *Y10T 16/44* (2015.01)

(58) Field of Classification Search
CPC ... Y10T 16/44; Y10T 16/455; Y10T 16/4554; Y10T 16/4563; Y10T 16/4571; Y10T 16/4644; Y10T 16/473; Y10T 16/48; Y10T 16/513; A45F 5/10; A45C 13/26; A45C 13/28; G09F 7/18; G09F 2007/186; G09F 21/02
USPC ..... 16/110.1, 114.1, 405, 407, 410, 419, 16/429, 431, 444; 40/586, 606.01, 611.01, 40/617; 190/115; 220/761
See application file for complete search history.

(56) References Cited

U.S. PATENT DOCUMENTS 2,006,786 A 7/1935 Beauvisage
2,158,697 A 5/1939 Harrison
3,031,359 A 4/1962 Blank et al.
3,289,798 A * 12/1966 Gehrie ..... 190/115
3,566,436 A * 3/1971 Marks et al. ..... 16/405
3,677,459 A * 7/1972 Susuki et al. ..... 229/117.24
4,176,423 A * 12/1979 Wigemark ..... 16/406
4,296,861 A 10/1981 Barash
4,667,829 A * 5/1987 Edmund-White ..... 206/575
5,185,904 A 2/1993 Rogers
5,509,689 A * 4/1996 Lin ..... 280/811
5,647,624 A 7/1997 Beshara
6,082,771 A * 7/2000 Long et al. ..... 281/37
7,000,962 B2 2/2006 Le
7,325,345 B2 * 2/2008 Hailo ..... 40/610
8,032,986 B2 10/2011 Lawrence

* cited by examiner

*Primary Examiner* — William Miller
(74) *Attorney, Agent, or Firm* — QuickPatents; Kevin Prince

(57) ABSTRACT

A handle for displaying and manually holding an advertising sign includes a C-shaped member having two opposing channels, a front side with a slot, a rear side, and two opposing ends. A handle terminates at each of two opposing ends with a T-shaped retention member that is slidably retained within the two opposing channels. The handle further includes a central portion situated in front of the C-shaped member. A pair of end caps each adapted for fixing with one of the ends of the C-shaped member is included, at least one of which includes a first fastener. A second fastener such as two-sided tape is fixed with the rear side of the C-shaped member. With the second fastener fixed with the sign, the handle may be pulled outwardly for holding the sign, or retracted to allow suspension of the sign from a wall, or the like, at the first fastener.

11 Claims, 3 Drawing Sheets

TWO-POSITION HANDLE

CROSS-REFERENCE TO RELATED APPLICATIONS

This application claims the benefit of U.S. Provisional Patent Application 61/877,897, filed on Sep. 13, 2013, and incorporated herein by reference.

STATEMENT REGARDING FEDERALLY SPONSORED RESEARCH AND DEVELOPMENT

Not Applicable.

FIELD OF THE INVENTION

This invention relates to handles, and more particularly to a handles for displaying an advertising sign.

DISCUSSION OF RELATED ART

Promotional or advertising signs that are energetically moved about to draw attention from passing motorists, or the like, have gained popularity due to their increased effectiveness over non-moving signs. For a person to be able to manipulate the position of such a sign, the rear of the sign needs an easily-grasped handle. However, conventional sign handles are rigid and cause the sign to be difficult to easily store or display when not being moved by a person. Further, such signs serve an important second purpose when displayed within a business establishment, for example, on a wall, but traditional handles do not facilitate such signs being easily mounted or displayed.

U.S. Pat. No. 3,031,359 to L. Blank et al on Apr. 24, 1962 teaches a pressure-sensitive adhesive tape handle that may be adhered to an object such as a box. Such a product does not lend itself well to attachment to signs since the handle tends to be laterally flexible, making it difficult to hold a sign. Further, such a product does not retract and, as a result, may cause the sign to tilt outward away from a wall onto which it is mounted for display in a retail environment, for example. U.S. Pat. No. 2,006,786 to Beauvisage on Jul. 2, 1935 suffers from similar drawbacks.

U.S. Pat. No. 5,185,904 to Rogers et al. on Feb. 16, 1993 teaches a plastic carrying handle that may be adhered to an object to be carried. While such a product does not suffer from lateral instability as with the Blank device, such a product also does not retract. U.S. Pat. No. 2,158,697 to Harrison on May 16, 1939 suffers from similar drawbacks.

U.S. Pat. No. 5,647,624 to Beshara, Jr. on Jul. 15, 1997 teaches an adhesive add-on bottle handle. Such a device is laterally stable due to an A-frame construction of the assembled handle, and such a device is able to be positioned into a retracted position that is substantially flat. However, retracting such a device is a three-step process. First one must disconnect the two handles from each other and then, one at a time, press each handle into its flat position on opposing sides of the device. Likewise, to reposition the handle into a deployed position, each side must be pulled away from the base and then each handle must be fastened together. If the adhesive on a tab that fastens the two handles together becomes worn or otherwise ineffective, then it is difficult to maintain the handle in the deployed position. Further, since each handle is fixed to the base at a living hinge, which hinges tend to wear out after repeated use, such a device is not suited for prolonged and repeated use.

U.S. Pat. No. 8,032,986 to Lawrence on Oct. 11, 2011 teaches a self-enclosed disposable carry handle. Such a device has a flexible handle strap and suffers from many of the drawbacks of the Blank device. Further, while such a device allows for a one-step extension of the handle, since the handle is flexible it cannot easily be retracted back into its base.

Therefore, there is a need for a device that can be easily attached to the back of an advertising sign and that provides an easy-to-use handle. Such a needed device would also be easily retracted to allow for easy storage or display, and would provide a display fastener for facilitating mounting or displaying of such a sign on a wall or other object. Such a needed invention would be relatively inexpensive to manufacture and easy to use, store and ship. The present invention accomplishes these objectives.

SUMMARY OF THE INVENTION

The present device is a handle for displaying an advertising sign on an object, such as a wall. The handle also provides for manually holding and manipulating the position of the sign. A rigid C-shaped member has two opposing channels, a front side that includes a longitudinally-aligned slot therein providing access to the two opposing channels, a rear side, and two opposing ends.

A resilient handle terminates at each of two opposing ends with a T-shaped retention member. Each retention member is slidably retained within the two opposing channels of the C-shaped member. The handle further includes a central portion adapted for manual grasping and situated in front of the front side of the C-shaped member. The central portion of the handle may further include a flat area adapted for receiving a promotional message applied thereto. Preferably between the central position and each end the handle includes a waist adapted for slidable engagement with the slot of the front side of the C-shaped member.

A pair of end caps each adapted for fixing with one of the ends of the C-shaped member is included. Preferably, at least one of the end caps includes a first fastener, such as an aperture traversing the end cap. Alternately, the first fastener may be a hook-and-loop type material, or other suitable two-part fastener for holding an item onto a vertical surface.

A second fastener is fixed with the rear side of the C-shaped member. Such a second fastener may be a two-sided adhesive tape, or a two-part hook-and-loop type material, or the like.

In use, with the second fastener fixed with the sign, the central portion of the handle may be pulled outwardly to extend the handle away from the front side of the C-shaped member and into an extended position, whereby the handle may be easily grasped by hand for manipulating the position and movement of the sign. The handle, when pushed back into contact with the C-shaped member achieves a retracted position, and the first fastener may then be used to suspend the sign from an object such as a wall to display the sign. In the embodiment wherein the first fastener is the aperture, a screw or nail may be used to suspend the sign from the wall, preferably with the handle in the refracted position. Clearly in such a use, the handle is affixed to the rear side of the sign so that the front of the sign is displayed.

The present invention is a handle device that can be easily attached to the back of an advertising sign and that provides an easy-to-use handle for a person to use to maneuver the sign. The present device is further easily retracted to allow for convenient storage or display of the sign. The present invention further provides a display fastener for facilitating mounting or displaying of such a sign on a wall or other object. The device is relatively inexpensive to manufacture and easy to use, store and ship. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
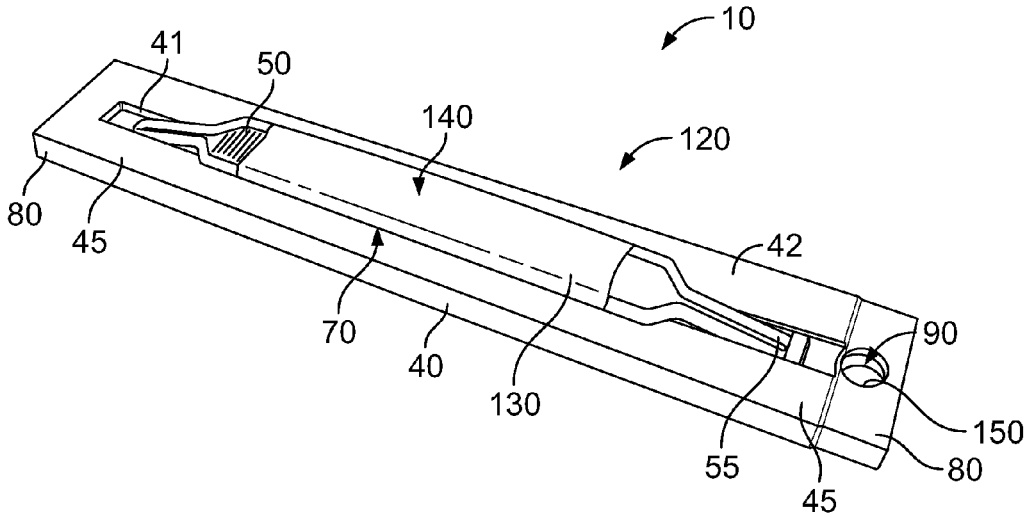
FIG. 1 is a front perspective view of the invention with a handle thereof in a retracted position.
Figure 2:
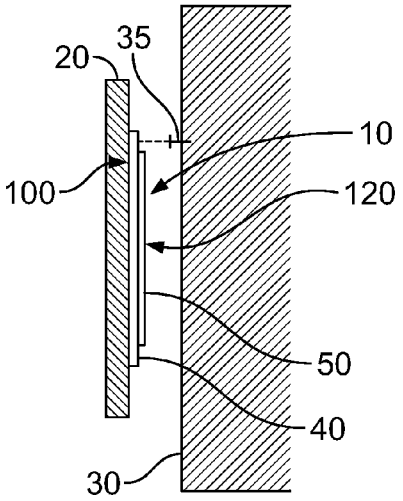
FIG. 2 is an exploded side elevational view thereof, illustrating a handle of the invention configured for holding a sign for display on a wall.

FIGS. 1 and 2 illustrate a handle 10 for displaying an advertising sign 20 on an object, such as a wall 30. The handle 10 also provides for manually holding and manipulating the position of the sign 20.

Figure 3:
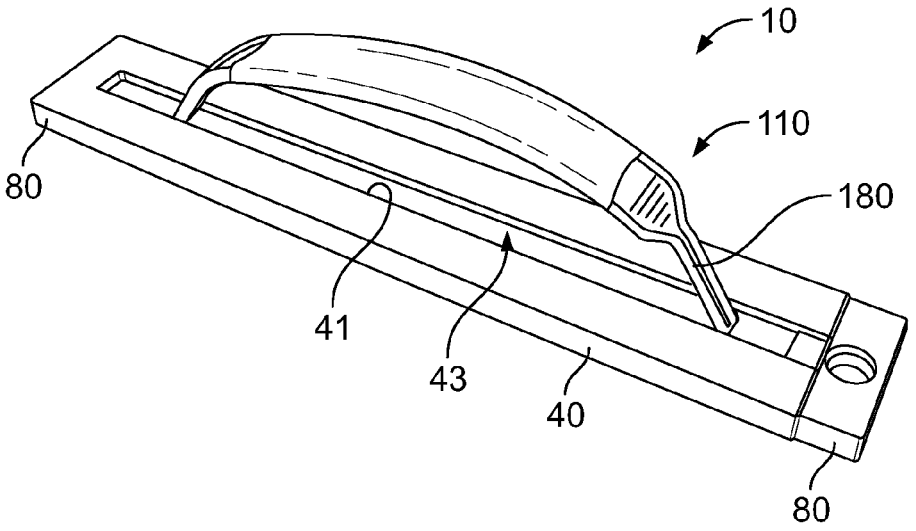
FIG. 3 is a rear perspective view of the invention, illustrating a second fastener thereof.
Figure 4:
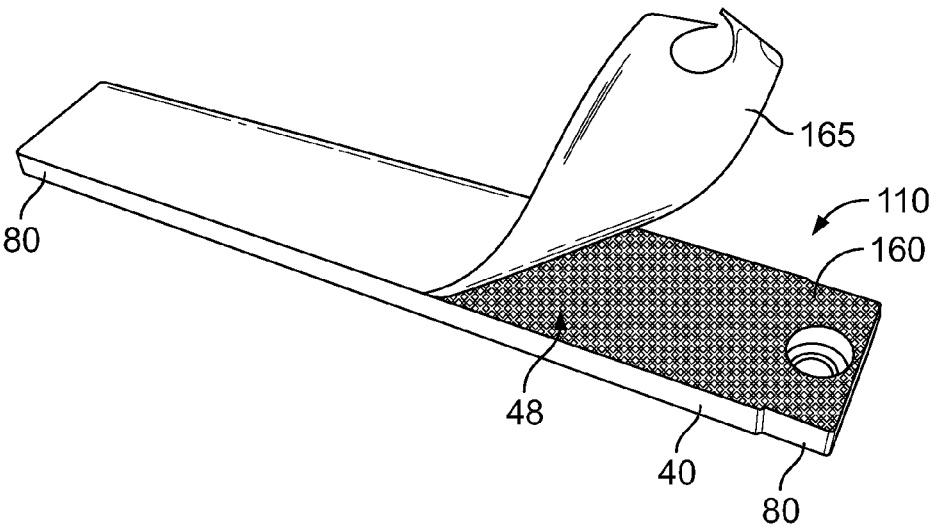
FIG. 4 is a front perspective view of the invention with the handle thereof in an extended position.

A rigid C-shaped member 40 has two opposing channels 43 (FIGS. 3 and 6), a front side 42 that includes a longitudinally-aligned slot 41 therein providing access to the two opposing channels 43, a rear side 48 (FIGS. 4 and 6), and two opposing ends 45. The C-shaped member 40 is preferably extruded from PVC or other suitable plastic material.

Figure 5:
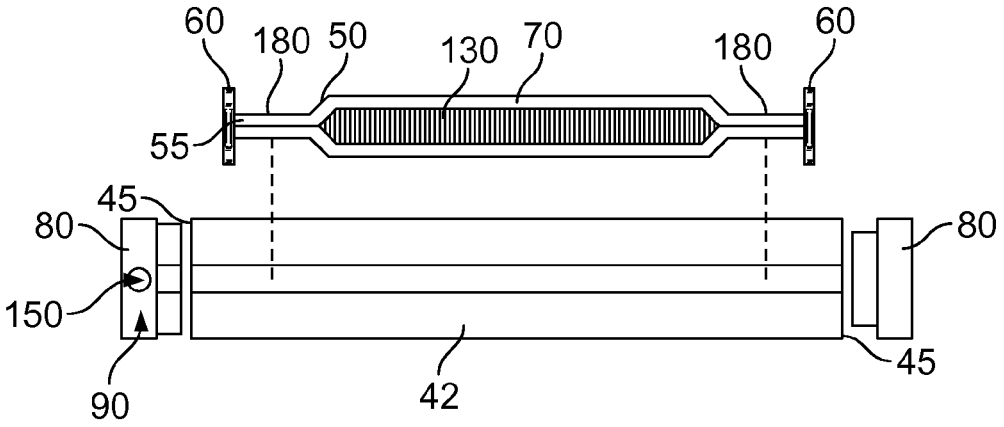
FIG. 5 is an exploded top plan view of the components of the invention.
Figure 6:
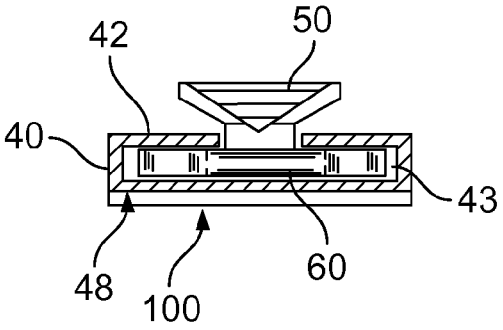
FIG. 6 is a side elevational view of the invention, illustrated with an end cap removed for clarity of illustration.

A resilient handle 50 terminates at each of two opposing ends 55 with a T-shaped retention member 60 (FIG. 5). Each retention member 60 is slidably retained within the two opposing channels 43 of the C-shaped member 40 (FIGS. 5 and 6).

The handle 50 further includes a central portion 70 adapted for manual grasping and situated in front of the front side 42 of the C-shaped member 40. The central portion 70 of the handle 50 may further include a flat area 130 adapted for receiving a promotional message 140 applied thereto (FIG. 1). Preferably between the central position 70 and each end 55 the handle 50 includes a waist 180 (FIGS. 3 and 5) adapted for slidable engagement with the slot 41 of the front side 42 of the C-shaped member 40. The handle 50 is preferably made from a pliable plastic or rubber material, such as polyethylene or other suitable material.

A pair of end caps 80 each adapted for fixing with one of the ends 45 of the C-shaped member 40 is included. Such end caps 80 are preferably injection molded from a suitable rigid or resilient plastic material. Preferably, at least one of the end caps 80 includes a first fastener 90, such as an aperture 150 traversing the end cap 80. Alternately, the first fastener 90 may be a hook-and-loop type material (not shown), or other suitable two-part fastener for holding an item onto a vertical surface. Each end cap 80 keeps the handle 50 captured within the channels 43.

A second fastener 100 is fixed with the rear side 48 of the C-shaped member. Such a second fastener 100 may be a two-sided adhesive tape 160 (FIG. 4), or a two-part hook-and-loop type material (not shown), or the like. The second fastener 100 fixes the end caps 80 into the C-shaped member 40, but the end caps 80 may also be sized to fit snuggly into the ends 45 of the C-shaped member 40 to be retained therein by friction.

In use, with the second fastener 100 fixed with the sign 20, the central portion 70 of the handle 50 may be pulled outwardly to extend the handle 50 away from the front side 42 of the C-shaped member 40 and into an extended position 110 (FIG. 3), whereby the handle 50 may be easily grasped by hand for manipulating the position and movement of the sign 20. The handle 50, when pushed back into contact with the C-shaped member 40 achieves a retracted position 120 (FIG. 1), and the first fastener 90 may then be used to suspend the sign 120 from an object such as a wall 30 to display the sign 20. In the embodiment wherein the first fastener 90 is the aperture 150, a screw or nail 35 (FIG. 2) may be used to suspend the sign 20 from the wall 30, preferably with the handle 50 in the retracted position 120. Clearly in such a use, the handle 10 is affixed to the rear side of the sign 20 so that the front of the sign 20 is displayed.

Preferably the T-shaped retention member 60 is square in cross-section and just fits within each channel 43, such that in the retracted position 120 each T-shaped retention member 60 tends to maintain its orientation within the channels 43, thereby acting as a detent to keep the handle 50 in the retracted position 120. In the extended position 110, each T-shaped retention member 60 is rotated 90-degrees by overcoming the frictional forces of the channels 43 pressing against the corners of the square T-shaped retention members as they rotate. Once past 45-degrees, such retention members 60 tend to snap into place within the channels 43 and rotated 90-degrees with respect to their position when in the retracted position 120. As such, once the handle 50 is pulled into the extended position 110 the handle 50 tends to stay in such a position, ready for easy manual grasping by the user.

In an alternate embodiment, the channels 43 have detents (not shown) that receive the retention members 60 of each end 55 of the handle 50. In such an embodiment, pressing the handle 50 towards the C-shaped member 40 overcomes the friction of the detents holding the retention members 60, which then slide down the channels 43 towards another detent (not shown) for maintaining the handle in the retracted position. Such an alternative embodiment is suitable when the C-shaped member is injection molded, but not well-suited for embodiments wherein the C-shaped member is extruded.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A handle for displaying and manually holding a planar advertising sign, the handle comprising:

a C-shaped member having two opposing channels, a front side having a longitudinally-aligned slot therein, a rear side, and two opposing ends;

a resilient handle terminating at each of two opposing ends with a T-shaped retention member, each retention member slidably retained within the two opposing channels of the C-shaped member, the handle further including a central portion adapted for manual grasping and situated in front of the front side of the C-shaped member;

a pair of end caps fixing with each end of the C-shaped member, at least one of the end caps including a first fastener; and a second fastener fixed with the rear side of the C-shaped member;

whereby with the second fastener fixed with the sign, the central portion of the handle can be pulled outwardly to extend the handle away from the front side of the C-shaped member into an extended position for grasping the sign at the handle, the handle when pushed into contact with the C-shaped member achieving a retracted position whereby the first fastener can suspend the sign from an object to display the sign.

2. The handle of claim 1 wherein the central portion of the handle includes a flat area adapted for receiving a promotional message applied thereto.

3. The handle of claim 1 wherein the first fastener is an aperture traversing the at least one end cap, whereby a screw or nail can suspend the sign with the handle in the retracted position on a wall at the aperture.

4. The handle of claim 3 wherein only one of the end caps includes the aperture.

5. The handle of claim 1 wherein the C-shaped member is formed from extruded PVC.

6. The handle of claim 1 wherein the handle is injection molded from a polyethylene material.

7. The handle of claim 1 wherein the second fastener is a two-sided adhesive tape.

8. The handle of claim 1 wherein the second fastener is a two-part hook-and-loop material.

9. The handle of claim 1 wherein the handle includes a pair of waists between the central portion and the ends thereof, each waist for slidable engagement with the slot of the front side of the C-shaped member.

10. The handle of claim 1 wherein the first fastener is a hook-and-loop material.

11. The handle of claim 1 wherein the T-shaped retention members are each square in cross-section and fit snuggly within each channel, whereby rotating the retention members when moving the handle from the retracted position to the extended position results in increased friction between the retention members and the channels.

* * * * *